US007513569B2

(12) United States Patent
Curiger

(10) Patent No.: US 7,513,569 B2
(45) Date of Patent: Apr. 7, 2009

(54) SYNCHRONOUS OFFICE CHAIR

(75) Inventor: Erwin Curiger, Ennetbaden AG (CH)

(73) Assignee: Stoll Giroflex AG, Koblenz (CH)

( * ) Notice: Subject to any disclaimer, the term of this patent is extended or adjusted under 35 U.S.C. 154(b) by 0 days.

(21) Appl. No.: 11/973,231

(22) Filed: Oct. 5, 2007

(65) Prior Publication Data

US 2008/0084100 A1 Apr. 10, 2008

(30) Foreign Application Priority Data

Oct. 6, 2006 (CH) ..... 1600/06

(51) Int. Cl.
*A47C 1/032* (2006.01)

(52) U.S. Cl. ..... 297/300.2; 297/303.1; 297/329

(58) Field of Classification Search ..... 297/300.1, 297/300.2, 300.3, 300.4, 320, 325, 329
See application file for complete search history.

(56) References Cited

U.S. PATENT DOCUMENTS 3,572,829 A * 3/1971 Malitte ..... 297/317
4,759,561 A * 7/1988 Janssen ..... 297/325
4,986,601 A 1/1991 Inoue
5,058,954 A * 10/1991 Kan-Chee ..... 297/317
5,354,120 A 10/1994 Völke
5,735,574 A * 4/1998 Serber ..... 297/284.4
5,785,384 A 7/1998 Sagstuen
5,810,440 A * 9/1998 Unwalla ..... 297/316
6,106,065 A * 8/2000 Carroll ..... 297/330
6,431,649 B1 8/2002 Hensel
6,641,214 B2 * 11/2003 Veneruso ..... 297/322

(Continued)

FOREIGN PATENT DOCUMENTS

EP 1 057 725 A2 12/2000

*Primary Examiner*—Peter R. Brown
(74) *Attorney, Agent, or Firm*—Collard & Roe, P.C.

(57) ABSTRACT

A synchronous office chair comprising a support (1) firmly connected with a supporting column, a seat base (2) articulated on a tilting axis (4) support with a flange (5) and a backrest (3) with a back bracket (6). The back bracket (6) features a first, second and third cam tracks (7, 8, and 9) and engages in an interstice between support (1) and seat base (2). Said seat base (2) with flange (5) and backrest (3) with back bracket (6) are formed to execute a synchronous movement. A first roller bearing (10) is mounted on flange (5) of seat base (2) that engages in the first cam track (7) of back bracket (6) and in which the synchronous movement is guided in first cam track (7). A second roller bearing 11 is mounted on seat base (2) that engages in second cam track (8) of back bracket (6) and in which synchronous movement is guided in second cam track (8). A third roller bearing (12) is mounted on support (1) that engages in third cam track (9) of back bracket (6) and in which synchronous movement is guided in third cam track. A synchronous movement takes place such that the seat base (2) with flange (5) execute a first tilting movement about a tilting axis (4), whilst backrest (3) with back bracket (6) execute a second tilting movement about a virtual axis (13). Based on the magnitude it is about two to three times as large as the first tilting movement and a translational movement at the same time. Moreover, the momentary pivot of the second tilting movement about the virtual axis (13) essentially lies at the same distance above the rear middle part of seat base (2).

7 Claims, 10 Drawing Sheets

U.S. PATENT DOCUMENTS 6,692,075 B2 * 2/2004 Sander et al. ..... 297/316
7,073,860 B2 * 7/2006 Markus ..... 297/316
7,090,240 B2 * 8/2006 Papac ..... 297/325

* cited by examiner 4
2
12
9
11
8
13
7
1
3
10
5
6

1
2
3
4
5
6
7
8
9
10
11
12
13

3
7
6
6
8
9
5
8

Inclination limit stop elements in 6° position

Inclination limit stop elements in 0° position

SYNCHRONOUS OFFICE CHAIR

The invention relates to a synchronous office chair according to Claim 1.

Commonly, one refers to seating furniture as a synchronous office chair if a seating surface and a backrest can execute coupled movements. As such, an office chair can be formed for instance so that the inclination of backrest part is coupled with a smaller inclination of the seating surface.

The present invention relates to a synchronous office chair in particular with essentially three main parts that interplay in generating the synchronous office chair movement. These three main parts are mounted on a supporting column, and comprise a support that is firmly connected with the supporting column, a seat base articulated on a tilting axis on the support and a backrest that is coupled with the support and the seat base. The tilting axis is located under the front area of the seating surface, thus in the knee region of a seated person.

Although numerous synchronous office chairs featuring a synchronous mechanism are already known, e.g. as disclosed in U.S. Pat. Nos. 5,354,120 or 6,431,649. However, they mostly consist of articulated mechanisms and frequently have a disadvantage in that the synchronous movement of the seating surface and backrest is inconveniently designed ergonomically and as such the "pull-out" effect occurs. Under this fact, one understands a known effect in that the shirt of a seated person is to some extent pulled out of the trousers when one leans back. The result is that the coupled relative or synchronous movements of the seating surface and backrest (at least in this relationship) are adjusted to one another inconveniently.

Object of the invention is to define an improved synchronous office chair in which the undesired "pull-out" effect is avoided to a greater extent.

This object of the invention is achieved through combinations of features in claim 1.

Furthermore, in the improved synchronous mechanism—also a well integratable apparatus for limiting the synchronous movement should be specified in the form of an inclination limit stop and an apparatus for restraining the synchronous movement should be specified in the form of initial tensioning.

A synchronous office chair according to the invention therefore essentially consists of the following parts:

- a support firmly connected with a supporting column,
- a seat base articulated on a tilting axis on the support and a flange firmly connected with the seat base,
- a backrest and a back bracket firmly connected with the backrest in which
  - a first cam track,
  - a second cam track, and
  - a third cam track are featured, and
  - in which the backrest bracket engages in an interstice between the support and the seat base and in which the flange of the seat base engages in the back bracket, moreover, in which the seat base with the flange and backrest with back bracket are formed for executing a synchronous movement.

Moreover, in the case of a synchronous office chair according to the invention:

- a first roller bearing is mounted on the flange of the seat base, which engages in the first cam track of the back bracket and in which the synchronous movement of the office chair is guided in the first cam track,
- a second roller bearing is mounted on the seat base, which engages in the second cam track of the back bracket and in which the synchronous movement of the office chair is guided in the second cam track,
- a third roller bearing is mounted on the support, which engages in the third cam track of the back bracket and in which the synchronous movement of the office chair is guided in the third cam track.

The synchronous movement in a synchronous office chair is formed by means of the above mentioned parts, such that the

- seat base with the flange executes a first tilting movement about the tilting axis,
- backrest with back bracket executes a second tilting movement about a virtual axis, which is about two to three times as large as the first tilting movement and at the same time also a translational movement,
- and the momentary pivot of the second tilting movement about the virtual axis essentially lies at the same distance above the rear middle part of the seat base.

The advantages of this solution in particular is that complicated lever mechanisms can be dispensed with and in particular the main object to avoid the "pull-out" effect is achieved. This object can be achieved already with only two movable main parts, namely the seat base and the backrest.

The synchronous movement, i.e. the rail-guided relative-movement of seat base and backrest is achieved through the roller-bearing guides in the cam tracks. The disclosed arrangement of the roller bearings and cam tracks has the effect that the momentary tilting movement pivot of the backrest about the virtual axis essentially always remains at about the same distance above the rear middle part of the seat base. For a person seated and leaning back on the synchronous office chair, the body pivot and momentary pivot of the backrest tilting movement about the virtual axis remain extensively consistent, leading to the pursued objective.

As already mentioned, the improved synchronous mechanism can be well combined with an apparatus for restraining the synchronous movement—namely in the form of initial tensioning. Here the objective is to achieve adjustable cushioning of seat base and backrest, which is optimally suitable and adjustable for very light as well as very heavy persons, and which is very reliable and durable. Through the application of leaf springs with an adjustable support as well as application of a bevel-gear drive displacing or positioning the support, one achieves not only a simple mechanical design but also the desired application scope.

It has been proved in particular that leaf springs made of glass-fibre composite material with uni-directionally aligned glass fibres provide the required mechanical strength properties and in particular also the desired durability. Other materials, like steel springs and similar are in contrast prone to very quick fatigue fractures and can generally also not be well dimensioned for the entire application scope of very light to very heavy persons.

As already mentioned, the improved synchronous mechanism can be well combined with an apparatus for limiting the synchronous movement—namely in the form of an inclination limit stop. The user of a synchronous office chair according to the invention should be able to an easily set and change the maximum backrest or seat base inclination respectively. In addition, one achieves the sought simple and reliable mechanical design by means of using a toothed segment on the support as well as a gear wheel with a limit stop disc and snap-in lever in an inclination mechanism holder on the seat base and an actuating device for activating the snap-in lever. The above mentioned elements for implementing the inclination limit stop actually cause the gear wheel that runs on the toothed segment—based on the inclination limit stop setting—to move only on a particular track section among the entire track at disposal on the toothed segment. When the snap-in lever is not engaged in the limit stop disc, the entire track at disposal on the toothed segment can be used. The user can, for instance, loosen the snap-in lever from the limit stop disc by means of a push button via a control cable, and tilt the synchronous office chair backwards into an arbitrary inclined position (within the possible, entire range of the synchronous movement) in order to search for a new limit stop position. Therefore, a very simple and appropriate operation is achieved here.

An exemplary embodiment of an office chair according to the invention is described in the following passage, by means of drawings.

The drawings show:

FIG. 1 shows a schematic side view of a synchronous office chair with a support, a seat base and a backrest at 0° seat base inclination, FIG. 2 shows a schematic side view of the synchronous office chair according to FIG. 1 at 11° seat base inclination, FIG. 3 shows a spatial view of the support according to FIG. 1 from the top, FIG. 4 shows a spatial view of the seat base according to FIG. 1 from the top, FIG. 5 shows a spatial view of the backrest according to FIG. 1 from the front, FIG. 6 shows a schematic side view of the support and seat base with the principle arrangement of initial tension elements, FIG. 7 shows an exposure of the initial tension elements, FIG. 8 shows a spatial view of the support with the initial tension elements, FIG. 9 shows a schematic side view of the support and seat base with the principle arrangement of the inclination limit-stop elements, FIG. 10*a* shows a schematic illustration of the inclination limit stop elements in 0°-position, and FIG. 10*b* shows a schematic illustration of the inclination limit stop elements in 6°-position.

FIG. 1 shows a schematic side view of a synchronous office chair with a support 1, a seat base 2 and a backrest 3 at 0° seat base inclination. Two of these three "main parts", namely seat base 2 and backrest 3 are movable such that synchronous movement occurs. Since FIG. 1 (as well as FIG. 2) mainly serves the purpose of illustrating the principle arrangement of the main parts, the support 1, the seat base 2 and backrest 3 are again shown in FIGS. 3-5 for illustrating their shape in spatial illustrations.

Support 1 is firmly connected with a supporting column (not depicted). The supporting column can be attached to an office chair foot in a manner typical for office chairs. Seat base 2 is articulated on tilting axis 4 on support 1. Seat base 2 features a flange 5 extending backwards and upwards of backrest 3. Seat base 2 and flange 5 are firmly connected with one another. Backrest 3 features a back bracket 6 extending downwards and forward towards seat base 2. Backrest 3 and back bracket 6 are likewise firmly connected with one another. Back bracket 6 of backrest 3 engages in an interstice between support 1 and seat base 2, and flange 5 of seat base 2 engages in back bracket 6.

Back bracket 6 features a first cam track 7, a second cam track 8, and a third cam track 9.

Cam tracks 7, 8, 9 are thereby all approximately circular in shape and concave from an observers viewpoint, who is standing in front and above the synchronous office chair. Moreover, the second and third cam tracks 8, 9 from side view (as shown here) are located close together so that they overlap.

A first roller bearing 10 is mounted on flange 5 of seat base 2, which engages in first cam track 7 of back bracket 6 and in which the synchronous movement of the office chair is guided in the first cam track 7.

A second roller bearing 11 is mounted on seat base 2, which engages in second cam track 8 of back bracket 6 and in which the synchronous movement of the office chair is guided in second cam track 8.

A third roller bearing 12 is mounted on support 1, which engages in third cam track 9 of back bracket 6 and in which the synchronous movement of the office chair is guided in third cam track 9.

When a user now sits on the synchronous office chair and leans back, then seat base 2 and backrest 3 execute said synchronous movement. Seat base 2 with flange 5 executes a first tilting movement about tilting axis 4. Backrest 3 with back bracket 6 executes a second tilting movement about a virtual axis 13, which is about two to three times as large as the first tilting movement. At the same time, backrest 3 with back bracket 6 also executes a translational movement downwards and forward. During the synchronous movement, the momentary pivot of the second tilting movement about virtual axis 13 essentially remains at the same distance above the rear middle part of the seat base. This is clearly visible in FIGS. 1 and 2, which are drawn in the same scale. Therefore, the movements of seat base 2 and backrest 3 are mutually rail-guided or coupled with one another—the reason why one speaks of a synchronous movement. The virtual axis position is selected such that they essentially always correspond to the pelvic pivot of a person that is seated on the synchronous office chair according to the invention.

The property of the synchronous office chair according to the invention that during the synchronous movement the momentary pivot of the second tilting movement about virtual axis 13 essentially always remains at the same distance above the rear middle part of the seat base, is intended and is achieved through the depicted design of the synchronous mechanism, in particular the arrangement of cam tracks 7, 8, 9 and roller bearings 10, 11, 12. It has the effect that the "pull-out" effect mentioned at the beginning does not occur or is rather strongly minimised.

FIG. 2 shows a schematic side view of the synchronous office chair according to FIG. 1 at 11° seat base inclination. Here, it is clearly visible that backrest 3 with back bracket 6 has executed a displacement movement downwards and forward and at the same time a rotary movement about virtual axis 13. For illustration, the momentary position of virtual axis 13 is also depicted here. One sees that the distance of virtual axis 13 to the top edge of seat base 2 has hardly changed.

One also observes here (also regarding FIG. 1) that the stationary position of the third roller bearing 12 on the support 1 is clearly visible. Likewise clearly visible is (again concerning FIG. 1) the stationary position of the second roller bearing 11 on seat base 2.

Figure 1:
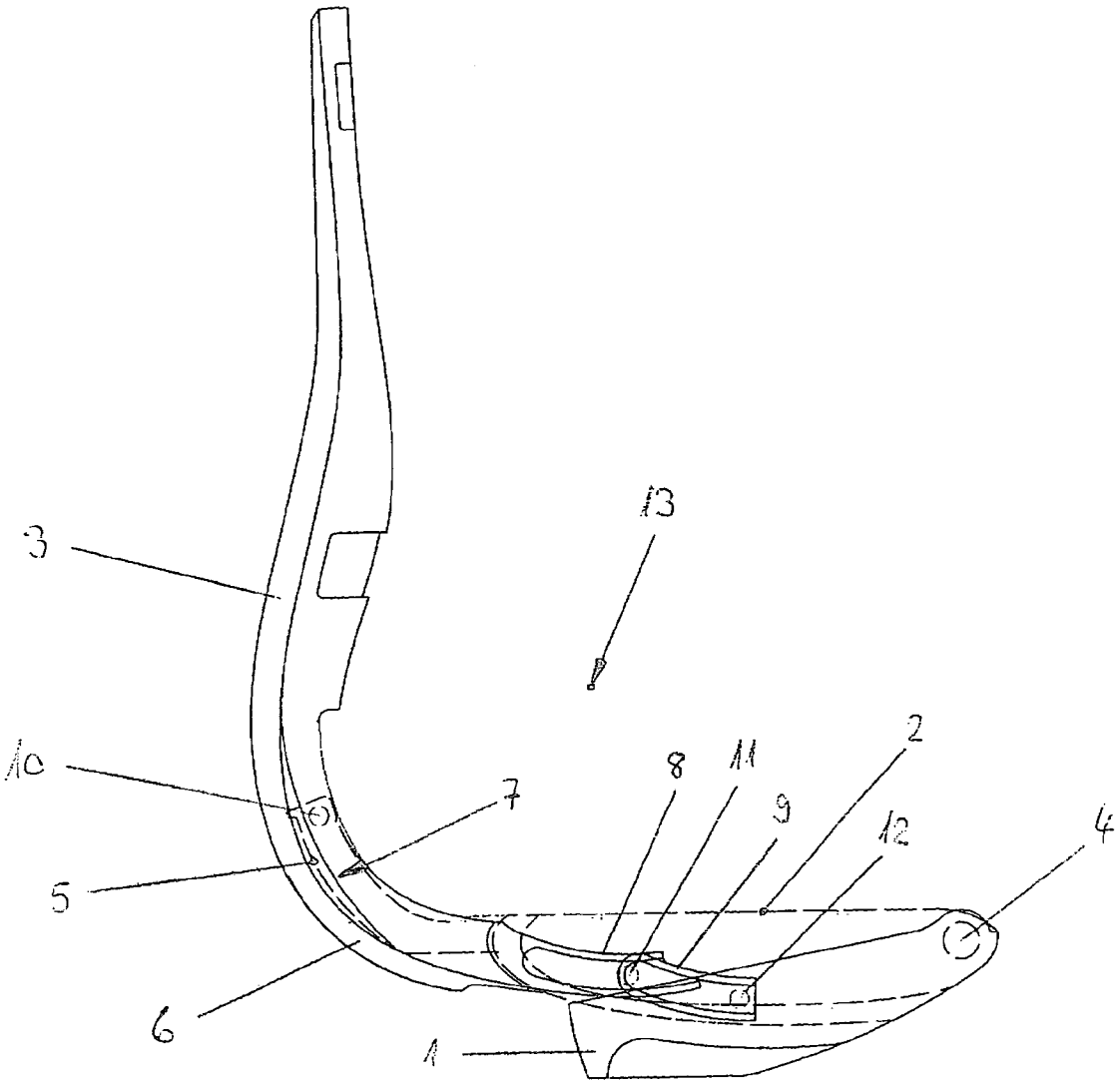
Figure 2:
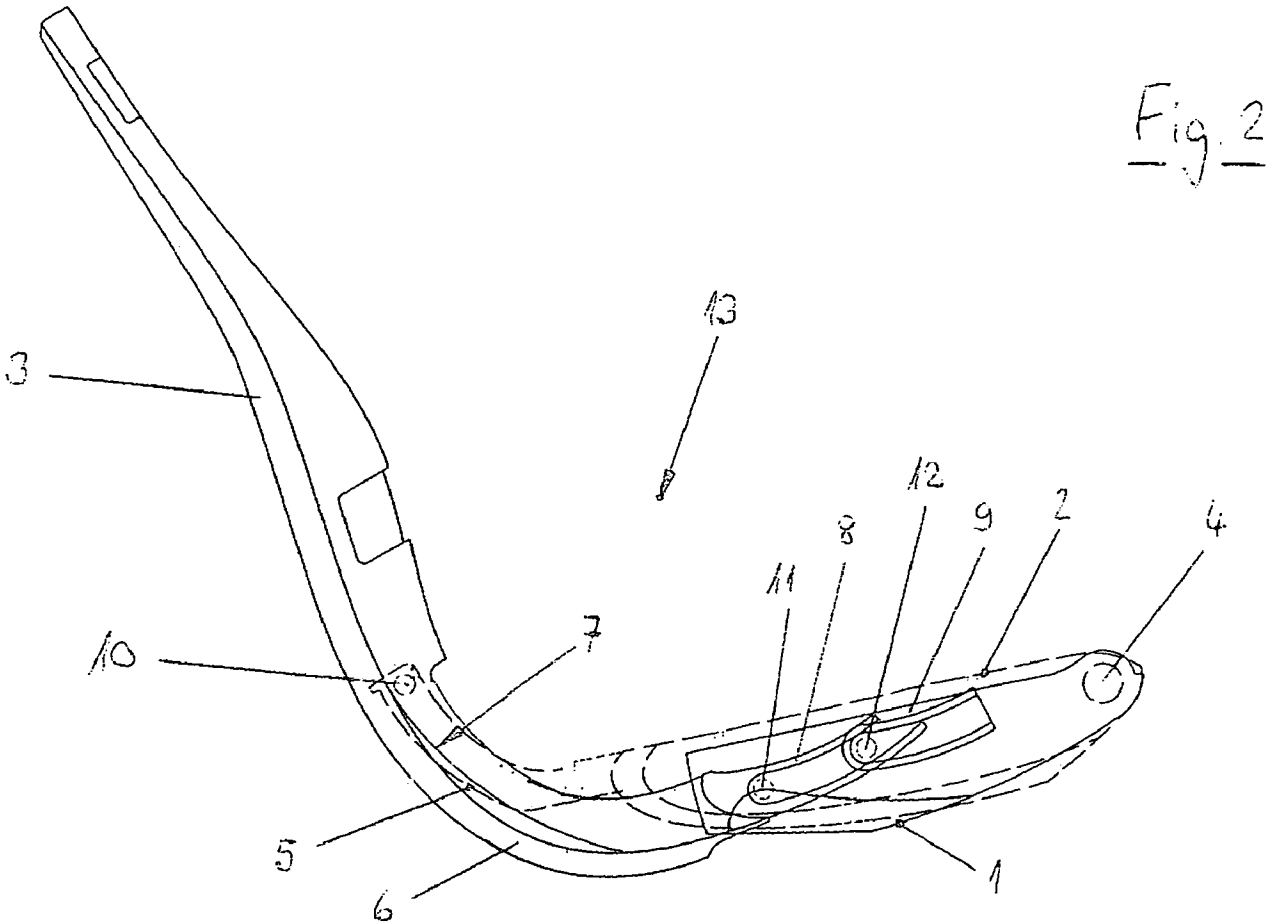
Figure 3:
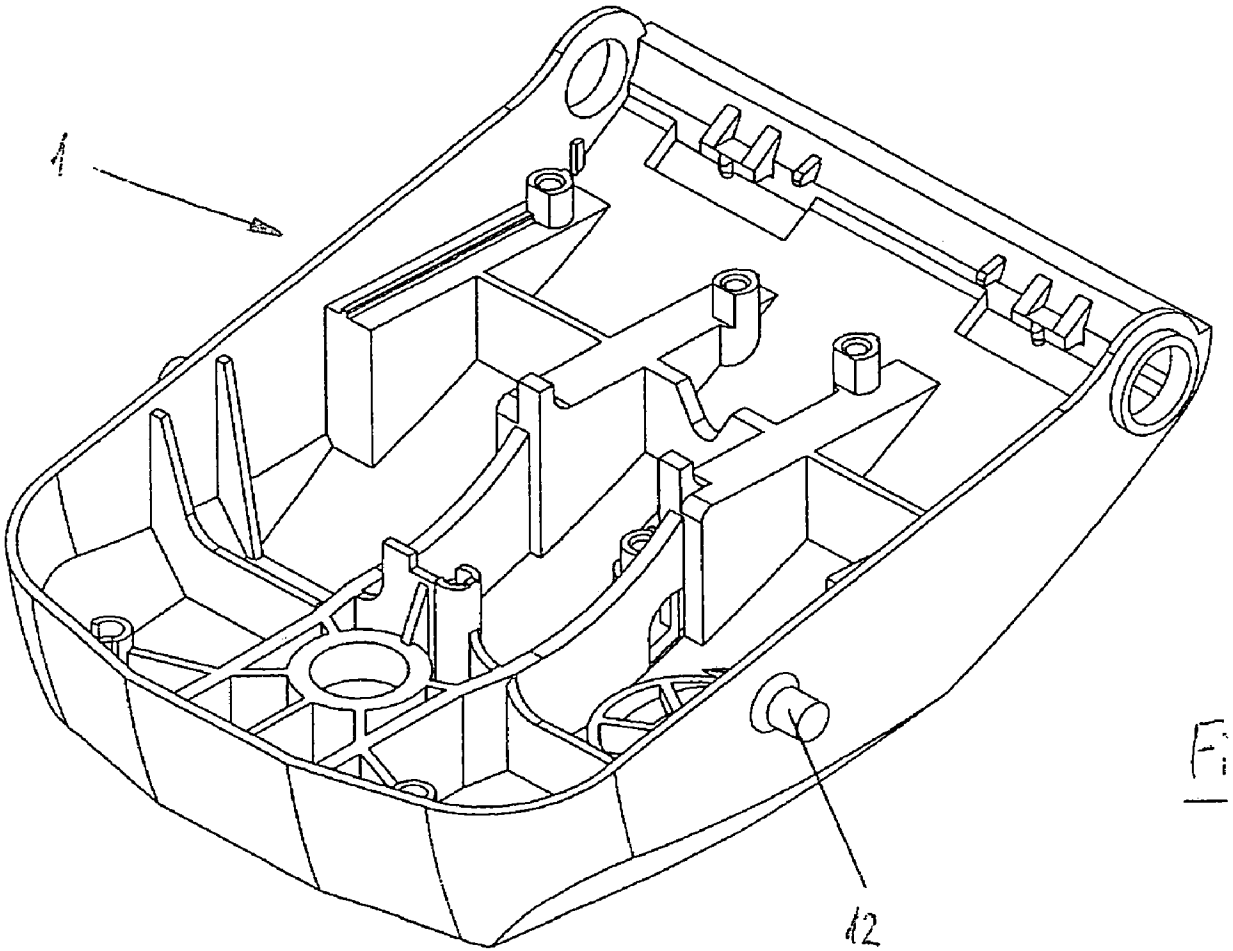
FIG. 3 shows a spatial view of the support according to FIG. 1, for clarification, in a view from the top and rear. The third roller bearing 12 is particularly clear here.
Figure 4:
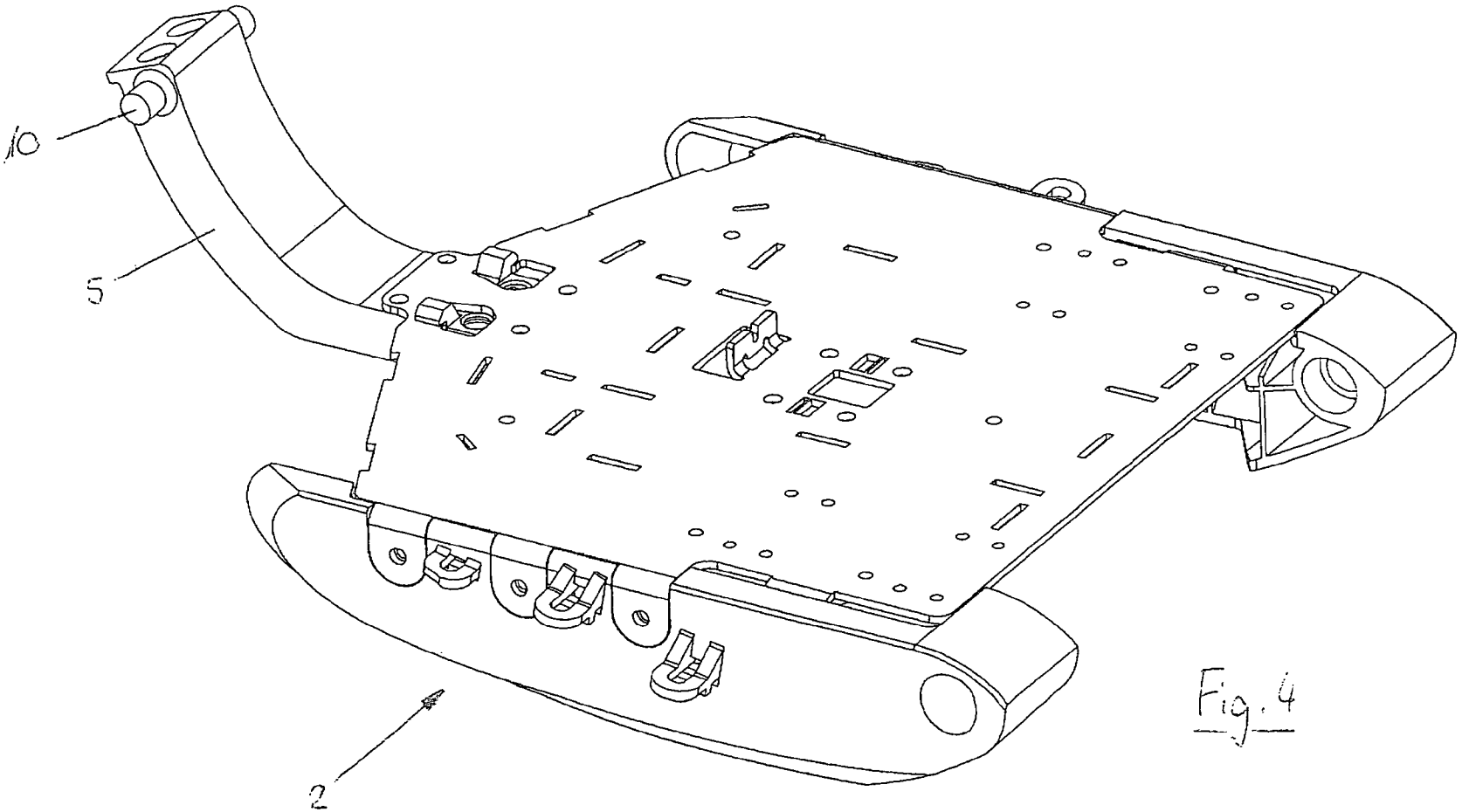
FIG. 4 shows a spatial view of the seat base according to FIG. 1, for clarification, in a view from the top and front.
Figure 5:
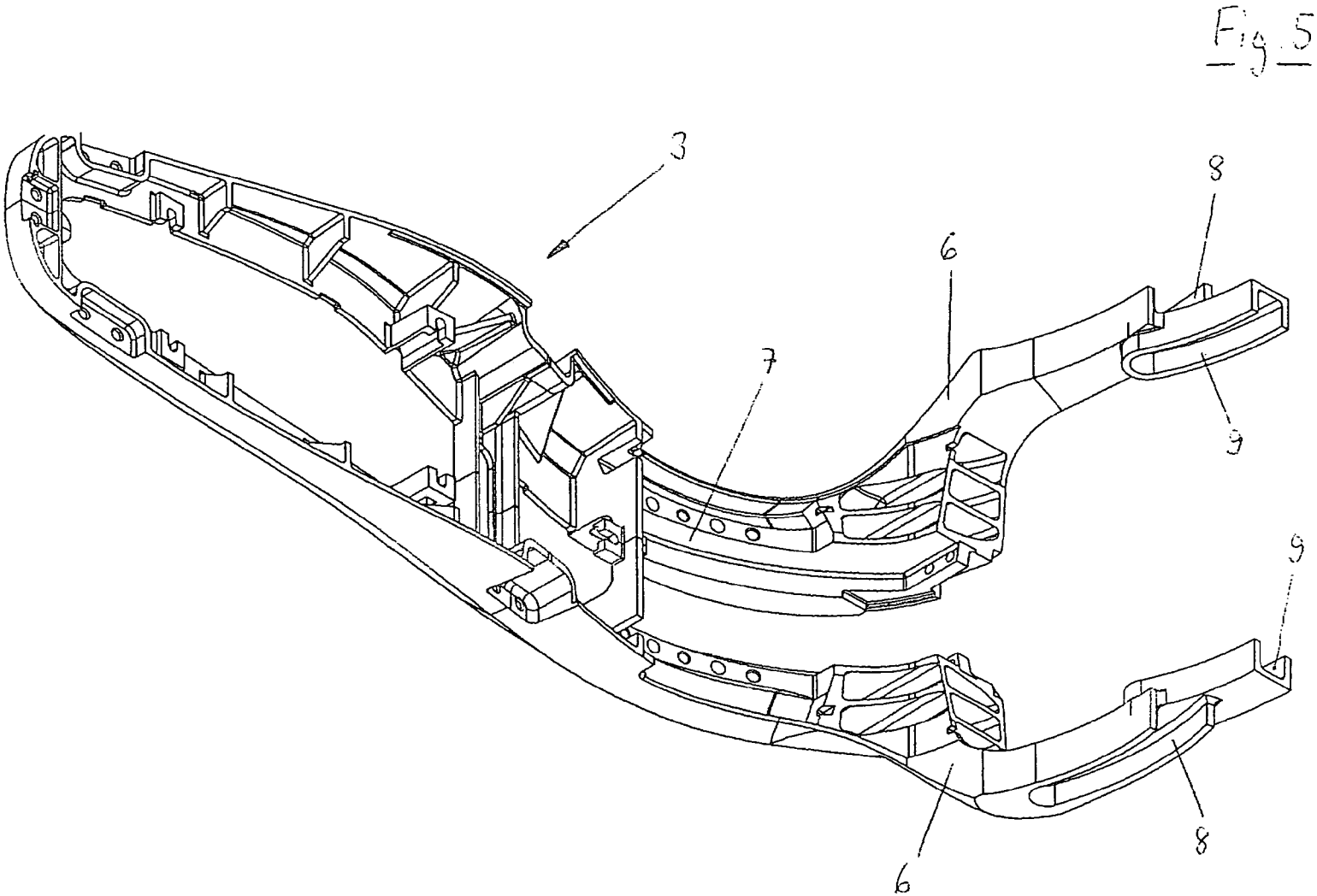
FIG. 5 shows a spatial view of the backrest according to FIG. 1, for clarification, in a view from the top and front. The first, second and third cam tracks 7,8,9 are particularly clear here.
Figure 6:
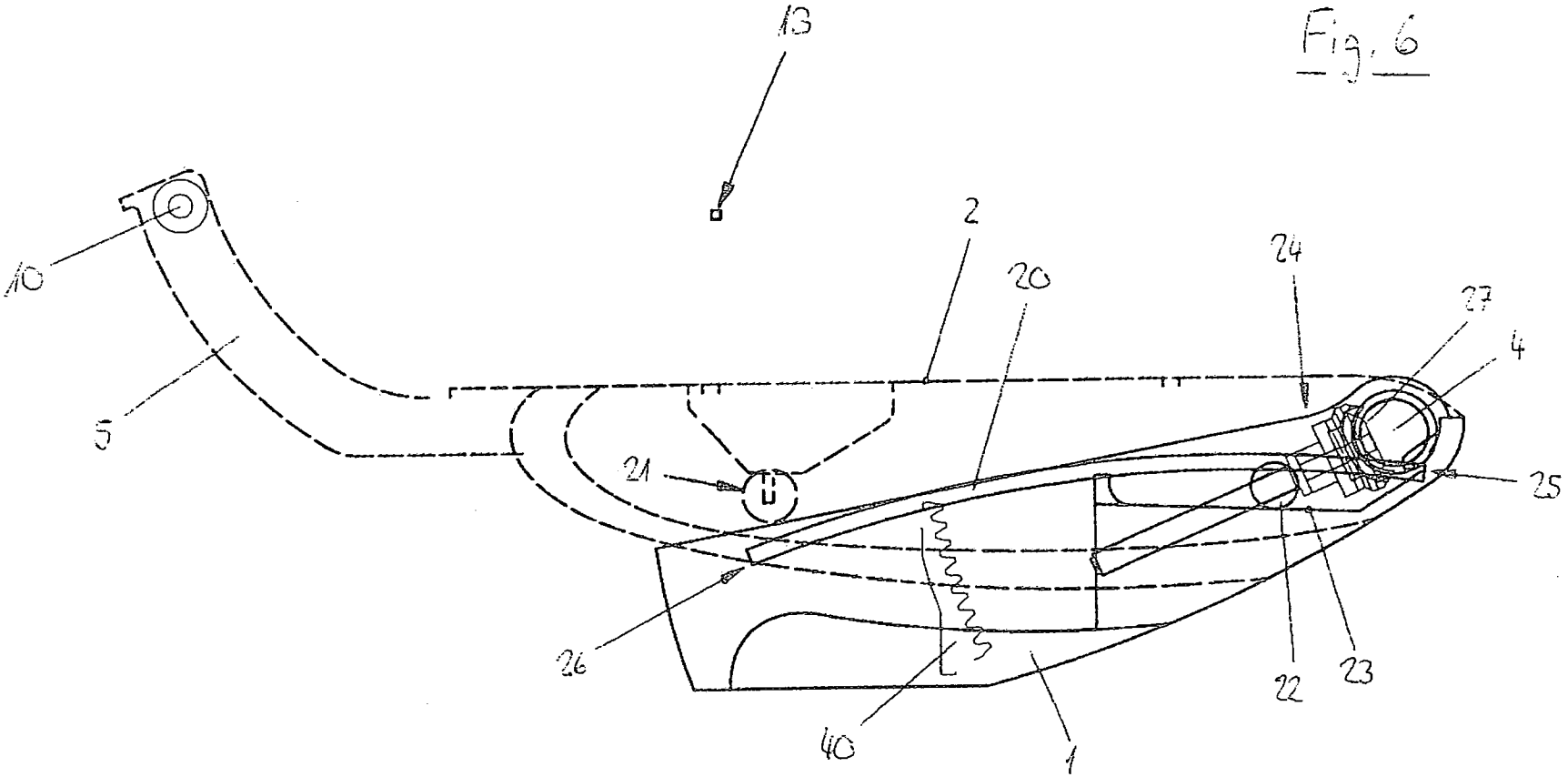

FIG. 6 shows a schematic side view of support 1 and seat base 2 with the principle arrangement of the elements of the initial tension. The most important elements of the initial tension comprise at least one leaf spring 20, a support device 21, a bearing 22, a support surface 23 as well as a positioning apparatus 24 for the bearing 22 on bearing surface 23.

At least one leaf spring 20 generates an initial pre-tensioning force and is fixed at a first leaf spring end 25 in a tilting axis 4 area on support 1. The second (opposite) leaf-spring end 26 is located under the rear middle part of seat base 2, movable vertically and in spring-loaded manner. Seat base 2 is or can be supported by means of support device 21 fixed on it at the rear middle seat base 2 part in a rolling or sliding manner on the leaf spring(s). The at least one leaf spring 20 is supported on bearing 22 that rolls or slides on bearing surfaces 23. By sliding or positioning bearing 22 on bearing surface 23, the initial tensioning force—thus the force counteracting the first tilting movement of seat base 2—can be adjusted in an infinitely variable (stepless) manner.

Positioning apparatus 24 for bearing 22 on bearing surface 23 can be designed in different ways; advantageously it is adjustable via a bevel gear drive 27, of which the drive axis is arranged coaxially with tilting axis 4.

The at least one leaf spring 20 consists preferably of a glass fibre plastic composite material with uni-directionally aligned glass fibres. The mechanical strength properties and reliability of these materials (common today) are so good that with the apparent leaf-spring design initial tension can be implemented in a force range that can cover the entire application range, from very light to very heavy persons.

Figure 7:
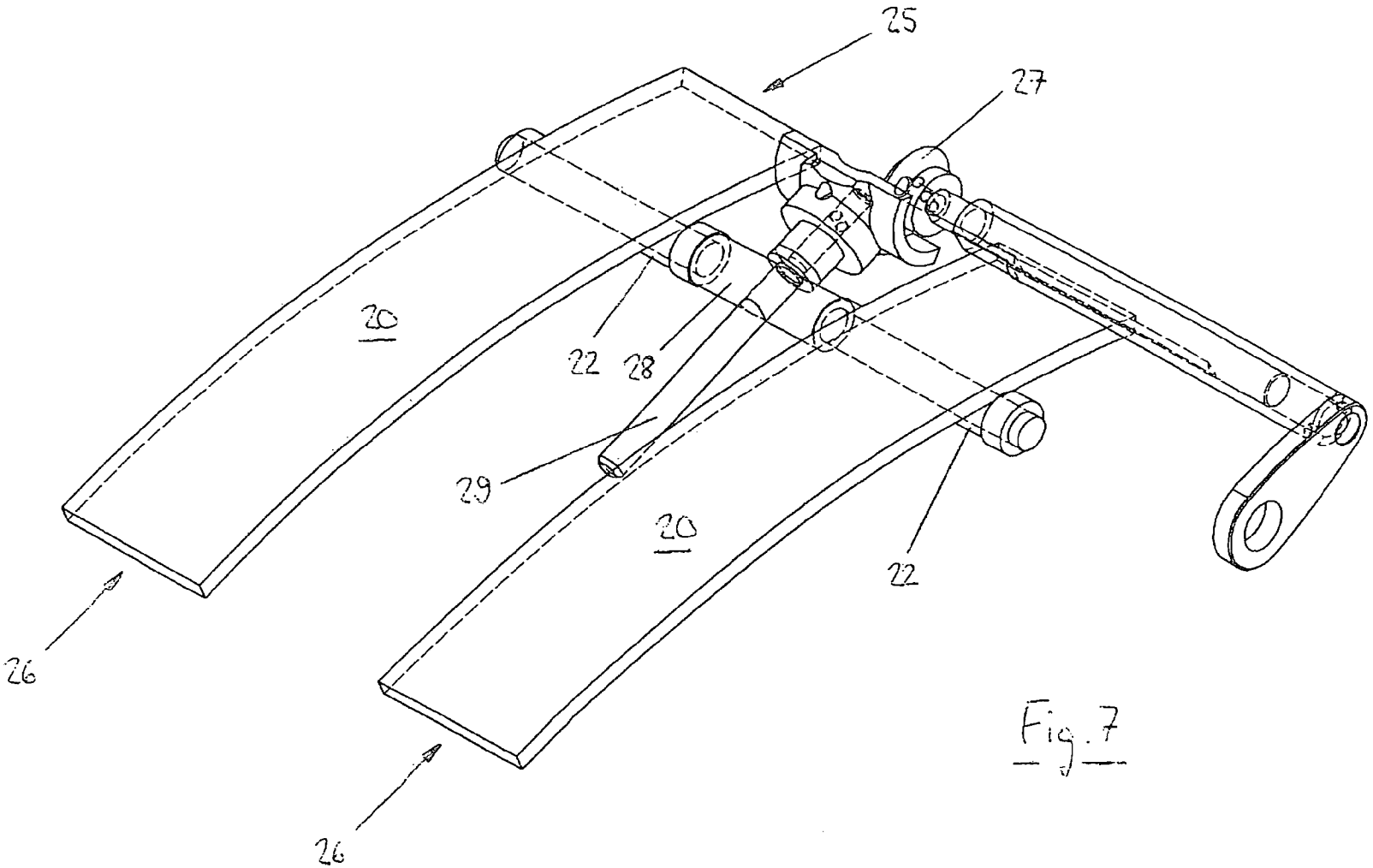

FIG. 7 shows an exposure of the initial tension elements for further clarification. An initial tension with two parallel leaf springs 20 is shown here, in which the means of supporting the leaf springs 20 here are essentially formed as cylindrical sliding bearings 22, and the two bearings 22 together can be positioned in a sliding manner by means of a shaft 28 and a thread spindle 29 via bevel gear drive 27 on bearing surface 23 (see FIG. 6). Obviously, also bearings capable of rolling could be provided.

Figure 8:
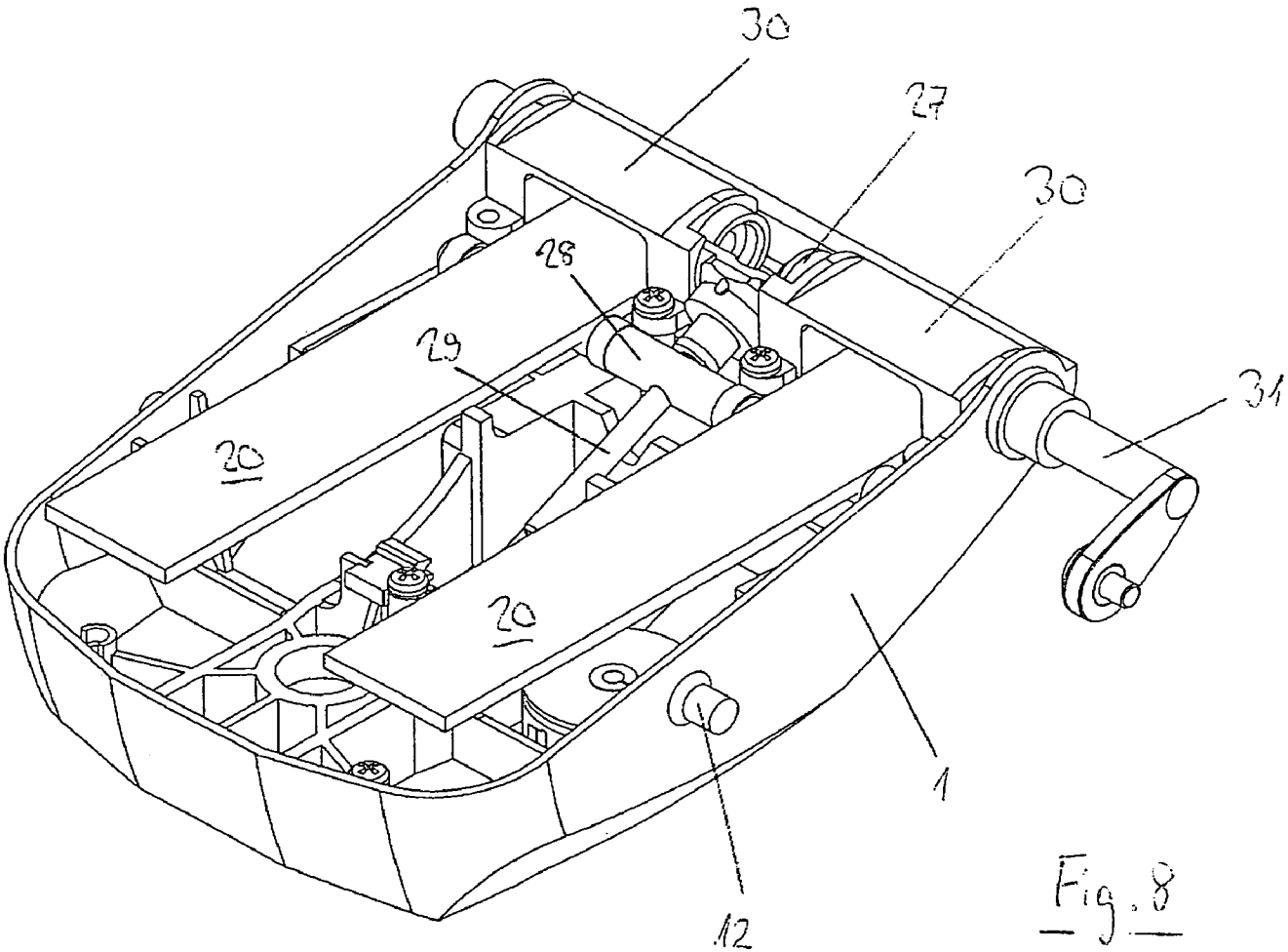

FIG. 8 shows a spatial view of support 1 with the initial tension elements. Plastic inserts 30 in which leaf springs 20 are held and fixed on first leaf spring ends 25 are additionally visible here besides bevel gear drive 27. The screw spindle 29 is rotatable by means of a crank 31 via bevel gear drive 27. Because screw spindle 29 is guided in a threaded hole on shaft 28, the position of bearing 22 on bearing surface can be shifted by rotating crank 31—thus adjusting the initial tensioning force.

Figure 9:
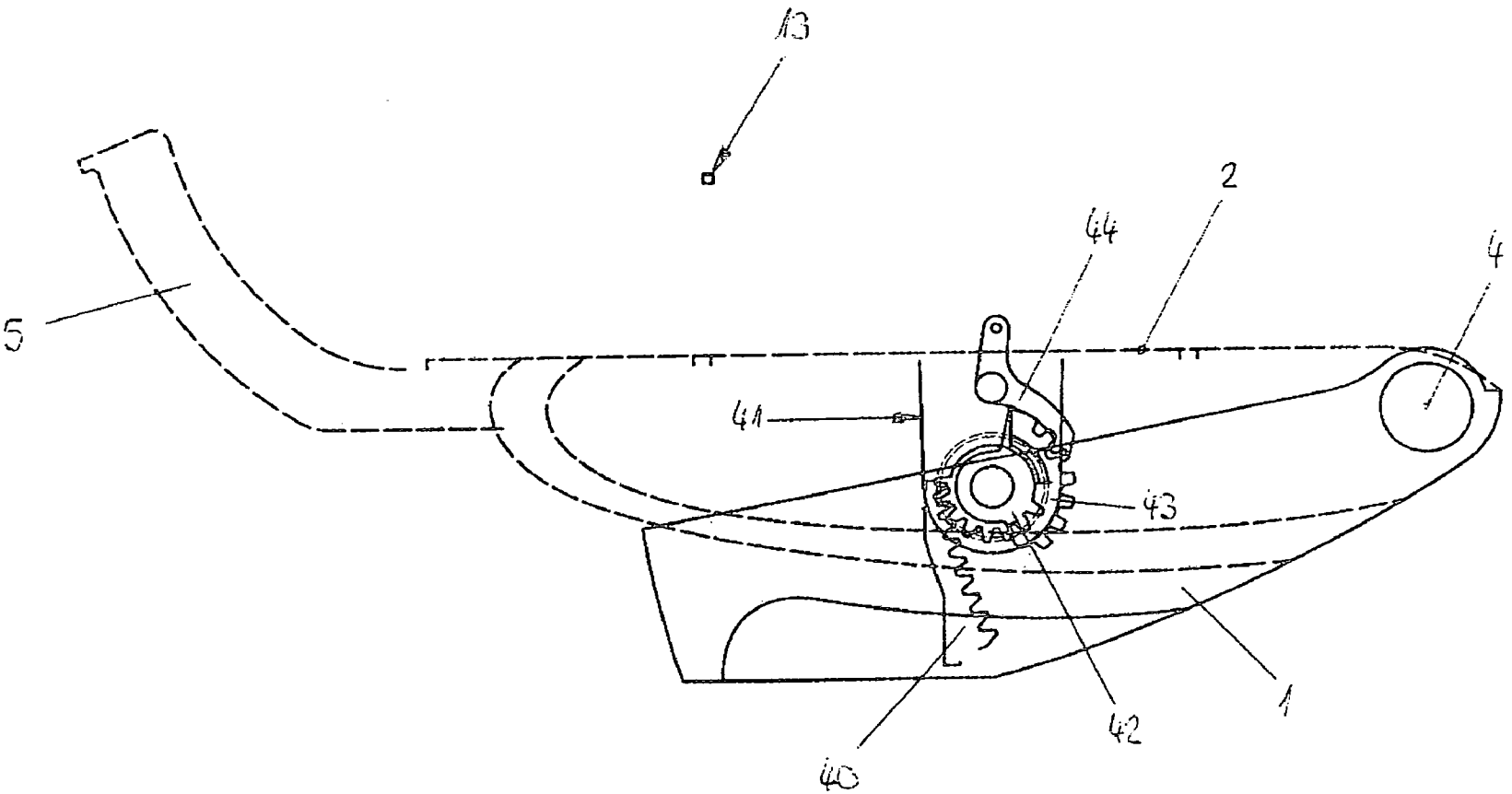

FIG. 9 shows a schematic side view of support 1 and seat base 2 with the principle arrangement of the inclination limit stop elements. The most important inclination limit-stop elements contain a toothed segment 40 attached to support 1 and an inclination mechanism holder 41 attached to seat base 2. The inclination mechanism holder 41 on its part essentially contains a gear wheel 42, a limit stop disc 43 and a snap-in lever 44. During a tilting movement of seat base 2 about tilting axis 4, gear wheel 42 moves on toothed segment 40 for a distance—here naturally along the path of a circular segment. This distance on the circular segment in the present exemplary embodiment is approximately 11° maximum (angular degree) when the inclination limit stop is fully released (deactivated). Since the gear wheel 42 (under the geometric relationships and owing to a relatively small circular segment) does not undergo a complete rotation when rolling on toothed segment 40, it does not need to be provided with teeth all over the entire circumference. With an activated inclination limit stop, the rolling-movement of gear wheel 42 on toothed segment 40 is blocked at a certain rolling position. The inclination limit stop is for instance activated/deactivated by means of an activating snap-in lever 44 that can occur by means of a push button via a control cable. Other actuation mechanisms, for instance via linkage are well known to the specialist and can obviously be used as alternative.

Figure 10B:
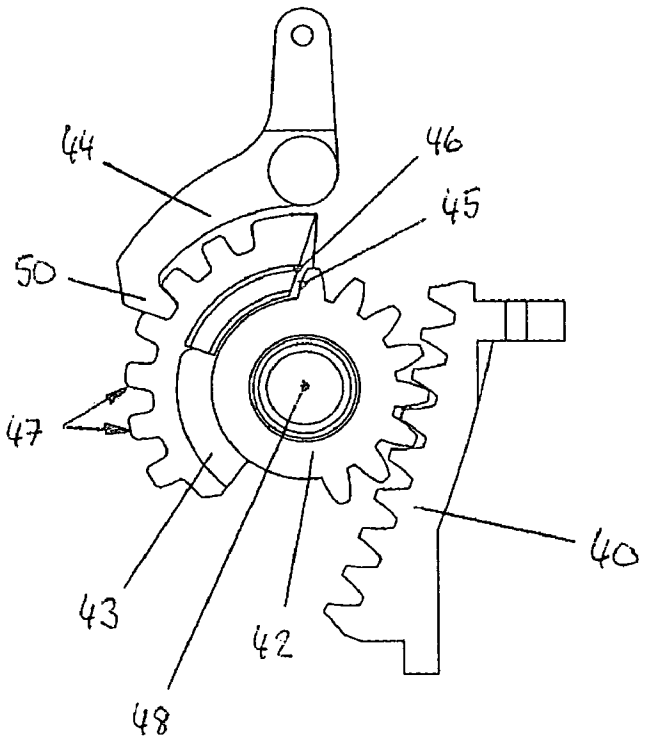
Figure 10A:
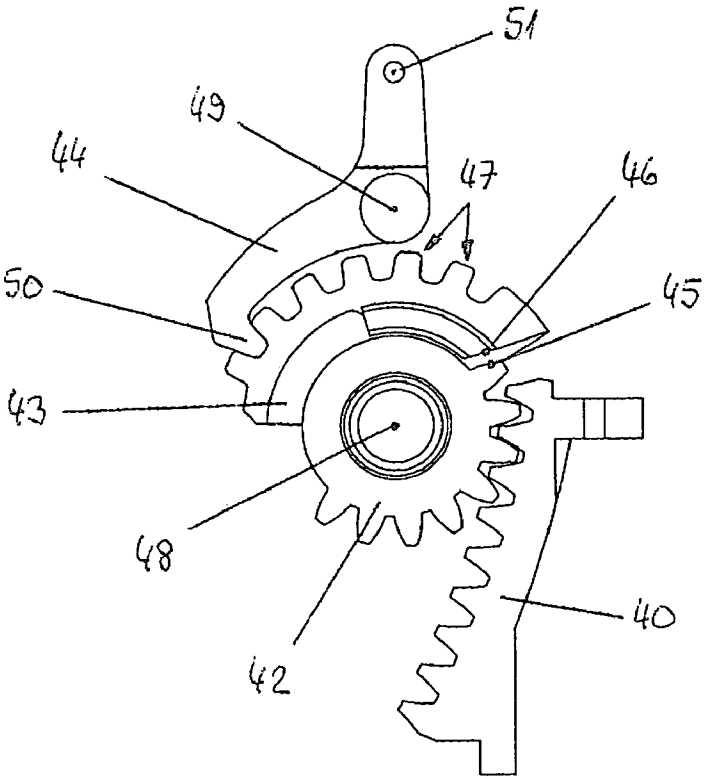

The design and operating mode of the inclination limit stop are described in more detail using FIGS. 10*a* and 10*b*. The only thing to be observed here is that FIGS. 9 and 10 depict views from opposite sides. This does not change anything in the functional principle.

FIG. 10*a* shows a schematic illustration of inclination limit stop elements in 0° position (the maximum inclination of seat base 2 about tilting axis 4 is set to 0° in this case). The remaining parts of the synchronous office chair have been omitted from this drawing to concentrate on essential function elements.

Parts in the inclination mechanism holder 41, thus gear wheel 42, limit stop disc 43 and snap-in lever are constructed in this exemplary embodiment as follows:

- gear wheel 42 features a gear wheel limit stop 45. As already mentioned, the gear wheel does not need to be toothed over the entire circumference. Gear wheel limit stop 45 in this case is formed by a flank of a first gear tooth and can as well be a separate limit stop that is firmly connected with the gear wheel.
- limit stop disc 43 features a disc limit stop 46. The disc limit stop 46 is formed to support or to act as a limit stop on gear wheel limit stop 45. Limit stop disc 43 features a series of grid teeth 47 along its circumference. As before, the grid teeth do not need to be provided on the entire circumference of the limit stop disc and a separate disc limit stop could be provided.
- gear wheel 42 and limit stop disc 43 are coaxially and at least partly mutually pivotally supported on an axis 48 in the inclination mechanism holder 41 that on the other hand is attached to seat base 2. The at least partly possible mutual twisting possibility occurs when gear limit stop 45 and disc limit stop 46 are mutually in contact (which is the case here).
- snap-in lever 44 is supported on a swivel axis 49 in the inclination mechanism holder and engages with a detent cam 50 in grid teeth 47 of disc limit stop 46. Snap-in lever 44 can be actuated by means of (not depicted) a cable pull via a grommet 51.

In FIG. 10*a*, the inclination of seat base 2 (not depicted) has a tilting angle of 0° (inclination about tilting axis 4). The inclination limit stop is activated because detent cam 50 of snap-in lever 44 engages in grid teeth 47 of limit stop disc 43 and thus obstructs rotation of limit stop disc 43. If a person sat on the synchronous office chair, then given an inactivated inclination limit stop, gear wheel 42 would run down the toothed segment 40 in counter-clockwise rotation. Such movement in this case is blocked due to gear wheel limit stop 45 and disc limit stop 46 lying in contact. The synchronous movement of the office chair is thus fully inhibited here.

In contrast to the state described above, when the inclination limit stop is deactivated, detent cam 50 of snap-in lever 44 does not engage in grid teeth 47 of limit stop disc 43. Therefore, the user of the synchronous office chair can lean back whilst the inclination limit stop is deactivated, for instance up to an inclination of seat base 2 about a 6° tilting angle (inclination about the tilting axis 4), through which the gear wheel 42 and the limit stop disc 43 reach the position shown in FIG. 10*b*. If the synchronous office chair user decides that this position should be his desired maximum inclination position, he can again activate the inclination limit stop in this position, i.e. he can again let the snap-in lever 44 with the detent cam 50 in this position engage in grid teeth 47 of limit stop disc. This is depicted in FIG. 10*b*.

FIG. 10*b* finally therefore shows a schematic illustration of the inclination limit-stop elements in the 6° position (the maximum inclination of seat base 2 about tilting axis 4 is set to 6° in this case). The inclination limit stop is activated because detent cam 50 of snap-in lever 44 engages in grid teeth 47 of limit stop disc 43 and thus obstructs rotation of limit stop disc 43. However, the tilting movement of seat base 2 is possible between the 0° and 6° inclination range in this case, because gear wheel 42 and limit stop disc 43 are at least partially pivotally mounted relative to one another on axis 48. If the inclination angle would be reduced in the example of FIG. 10*b*, then gear wheel 42 would rotate in clockwise direction on toothed segment 40, because this mutual rotation between gear wheel 42 and limit stop disc 43 is not inhibited by limit stops 45, 46. Therefore, the disclosed inclination limit stop acts as a means of limiting the synchronous movement, i.e. synchronous movement can be limited to a desired inclination position of seat base 2 or backrest 3 corresponding to the selectable rotation position of limit stop disc 43.

In fact the geometry and design of the inclination limit stop according to the invention must not necessarily correspond exactly to the depicted exemplary embodiment. As such, gear wheel 42 with gear wheel limit stop 45 and limit stop disc 43 with disc limit stop 46, for instance, must not be made as one piece and neither gear wheel 42 nor limit stop disc 43 must be provided with gear teeth on only a part of the circumference.

Both the inclination limit stop and initial tension apparatus are altogether particularly suitable for use in an office chair with a synchronous movement designed according to the invention. The inclination limit stop allows an optional and particularly easily operated limit of the synchronous movement with simple means, whilst the initial tension is mainly well suitable due to very large setting range, but also due to principle simplicity.

As already mentioned earlier in the depicted exemplary embodiment, seat base 2 and flange 5 are firmly connected with one another, just like backrest 3 and back bracket 6. It is obviously possible without further effort to design the respective parts such that they can be either assembled from different parts or made as a single piece.

The invention claimed is:

1. A synchronous office chair, comprising:

a) a support firmly connected to a supporting column;

b) a seat base articulated on a tilting axis on said support, said tilting axis disposed at a front area of said seat base and extending in a direction across a width of said seat base;

c) a flange firmly connected to said seat base;

d) a backrest and a back bracket firmly connected with said backrest, said back bracket engaging in an interstice between said support and said seat base and said flange engaging in said back bracket, wherein said seat base with said flange and said backrest with said back bracket are formed to execute a synchronous movement, said back bracket comprising:

i) a first cam track;

ii) a second cam track positioned forward of said first cam track; and iii) a third cam track positioned forward of said second cam track;

e) a first roller bearing mounted on said flange, said first rolled bearing engaging in said first cam track, wherein the synchronous movement of the synchronous office chair is guided in said first cam track;

f) a second roller bearing mounted on said seat base, said second roller bearing engaging in said second cam track, wherein the synchronous movement of the synchronous office chair is guided in said second cam track; and g) a third roller bearing mounted on said support, said third roller bearing engaging in said third cam track, wherein the synchronous movement of the office chair is guided in said third cam track;

wherein the synchronous movement of the synchronous office chair is formed such that said seat base with said flange executes a first tilting movement about said tilting axis;

wherein said backrest with said back bracket executes a second tilting movement about a virtual axis corresponding to a pelvic pivot of a person sitting on the synchronous office chair, said second tilting movement being approximately two to three times as large as said first tilting movement and said backrest with said back bracket executing a translational movement downward and forward at the same time as said second tilting movement; and wherein a pivot point of said second tilting movement about said virtual axis at all times lies essentially at a same distance above a rear middle part of said seat base, such that as the person sitting on the synchronous office chair leans back, a body pivot point of the person and the pivot point of said second tilting movement about said virtual axis remain substantially consistent.

2. A synchronous office chair according to claim 1, further comprising a first apparatus for limiting the synchronous movement, said first apparatus comprising an inclination limit stop and/or a second apparatus for restraining the synchronous movement, said second apparatus providing an initial tension.

3. A synchronous office chair according to claim 2, further comprising:

at least one leaf spring attached to said support for applying an initial force for said initial tension, said at least one leaf spring comprising a first leaf spring end fixed in an area of said tilting axis on said support and a second leaf spring end arranged in a movable and spring-loaded manner in an area under the rear middle part of said seat base;

a support device on the rear middle part of said seat base for supporting said seat base in a rolling or sliding manner on said at least one leaf spring, and;

a rolling or sliding bearing provided on a bearing surface on which said at least one leaf spring is supported, wherein said initial force can be set by shifting said bearing on said bearing surface.

4. A synchronous office chair according to claim 3, further comprising a bevel gear drive for positionally setting said bearing.

5. A synchronous office chair according to claim 3, wherein said at least one leaf spring comprises a glass fibre plastic composite material with uni-directionally aligned glass fibre.

6. A synchronous office chair according to claim 2, further comprising:

a toothed segment attached to said support;

a gear wheel attached to said seat base, wherein said gear wheel engages in said toothed segment and during the synchronous movement said gear wheel is movable up and down in said toothed segment, said gear wheel comprising a gear wheel limit stop;

an inclination mechanism holder attached to said seat base;

a limit stop disc attached to said seat base, said limit stop disc comprising a disc limit stop; wherein said gear wheel and said limit stop disc are supported coaxially and at least partially rotatably on an axis relative to one another; and a snap-in lever attached to said seat base, said snap-in lever for locking said limit stop disc in a selectable rotating position relative to said inclination mechanism holder;

wherein the synchronous movement of the synchronous office chair can be limited accordingly in a desired inclination position of said seat base or of said backrest according to a selectable rotating position of said limit stop disc in which said gear wheel limit stop and said disc limit stop are mutually moved into contact.

7. A synchronous office chair according to claim 6, further comprising an actuating device for detaching or unlatching said snap-in lever from said limit stop disc; wherein at the selectable rotating position of said limit stop disc associated with a corresponding inclination position of said seat base or said backrest, said snap-in lever may be latched to said limit stop disc.

* * * * *